US007384116B2

(12) United States Patent
Kotaki et al.

(10) Patent No.: US 7,384,116 B2
(45) Date of Patent: Jun. 10, 2008

(54) LIQUID CONTAINER AND INK JET PRINTING APPARATUS

(75) Inventors: Yasuo Kotaki, Yokohama (JP); Keisuke Matsuo, Yokohama (JP); Kenji Kitabatake, Kawasaki (JP); Hiromasa Amma, Kawasaki (JP); Naoki Tashiro, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 352 days.

(21) Appl. No.: 11/250,461

(22) Filed: Oct. 17, 2005

(65) Prior Publication Data

US 2006/0082625 A1 Apr. 20, 2006

(30) Foreign Application Priority Data

Oct. 20, 2004 (JP) ..... 2004-306130

(51) Int. Cl.
*B41J 29/393* (2006.01)
*B41J 2/175* (2006.01)

(52) U.S. Cl. ..... 347/19; 347/86

(58) Field of Classification Search ..... 347/7, 347/19, 86, 87; 250/577; 399/64
See application file for complete search history.

(56) References Cited

U.S. PATENT DOCUMENTS 5,616,929 A * 4/1997 Hara ..... 250/573
6,302,535 B1 * 10/2001 Sturgeon et al. ..... 347/86
6,422,675 B1 * 7/2002 Tomomatsu ..... 347/7
6,454,400 B1 9/2002 Morita et al. ..... 347/86
6,869,158 B2 3/2005 Kojima et al. ..... 347/19
2005/0219303 A1 10/2005 Matsumoto et al. ..... 347/19
2006/0087538 A1 4/2006 Amma et al. ..... 347/86
2006/0139384 A1 6/2006 Kitabatake et al. ..... 347/7

FOREIGN PATENT DOCUMENTS

JP 4-275156 9/1992
JP 2001-253087 9/2001
JP 2002-301829 10/2002

* cited by examiner

*Primary Examiner*—Anh T. N. Vo
(74) *Attorney, Agent, or Firm*—Fitzpatrick, Cella, Harper & Scinto

(57) ABSTRACT

A structure for informing a state of the ink tank by a light emitting section such as LED, capable of displaying such information at a position easily visible by the user and favorably sending the emitted light both to the user and a light receiver section on the printer side without needing electric wiring which may disturb the user's visibility or manipulation. The light emitting section is separated from the display section and a light guiding section is provided between the both. A member for suitably limiting the emission of light is provided in the display section. Thereby, it is possible to dispose the display section at the best position without needing the electric wiring on the ink tank and obtain a preferable light volume suitable both for the improvement in user's visibility and the stability of the operation of the light receiving section.

11 Claims, 15 Drawing Sheets

LIQUID CONTAINER AND INK JET PRINTING APPARATUS

BACKGROUND OF THE INVENTION

1. Field of the Invention

The present invention relates to a liquid container, more specifically to a liquid container wherein information relating to a state of the liquid container, such as a remaining amount of ink in an ink tank used on an ink jet printing apparatus is detected by a light-emitting means, for example, LED.

2. Description of the Related Art

Recently, as digital cameras have widely prevailed, uses are increasing wherein the printing is carried out while directly connecting a digital camera to a printer as a recording device without the intervention of a personal computer (PC). Such a printing is called as a "camera direct printing". Further, a printing method is also increasing wherein a card type information storing medium used for the digital camera in a detachable manner is directly mounted to a printer so that data are transferred and printed. This is called as a "card direct printing" Also, a so-called multifunction printer has quickly been prevailing in the market, wherein a printer is integrated with a scanner to have a copying function without the intervention of PC, as well as the above-mentioned direct printing function.

In an ink jet printer, there are cases wherein a user desires to know information relating to individual ink tank such as a mounting state of the ink tank or a remaining amount of ink in the ink tank or it is desirable to inform such information to the user. For example, if the user knows that the remaining amount of ink in the ink tank is little, it is possible to avoid an accident wherein the printing is substantially impossible during the printing operation due to the lack of ink, by replacing the old ink tank with a fresh one prior to beginning the printing operation.

Conventionally, such information is informed to the user by transferring the same to a PC connected to the printer and being displayed on a monitor of the PC. Contrarily, when the printing is carried out without the intervention of the PC, it is thought that a display is provided in a printer body to display such information. The provision of the display, however, is not always desirable since it causes to increase a production cost and enlarge a size of the printer, as well as requires to change a design of the printer. Also, if the display is provided, it is not certain that the user clearly seizes the state of the ink tank at a glance.

In the prior art, a display element such as an LED has been known as means for informing a state of the ink tank to the user. In Japanese Patent Application Laid-open No. 4-275156 (1992), it is described that two LEDs are provided in an ink tank formed integral with a printing head, and are turned on, respectively, in correspondence to two stages of the remaining amount of ink. More concretely, an ink cartridge in which the ink tank is integral with the printing head is provided with means for counting the number of electric switchings of the printing head and means for storing the counted number. Further, the ink cartridge is provided with an LED for displaying a near end, capable of lighting when the accumulated value of the counted number reaches a near end-determining value, and an ink end LED capable of lighting when an ink end-determining value has been reached, so that the state of the ink tank is informed to the user.

Similarly, in Japanese Patent Application Laid-open No. 2002-301829, a lamp is described, provided in an ink tank or a carriage for mounting the same, capable of lighting in correspondence to the remaining amount of ink. Also, in this patent document, the above-mentioned lamp is provided in each of four ink tanks used in a printing apparatus.

On the other hand, in accordance with the recent requirement for the further improvement in image quality, light magenta or light cyan ink has been used in addition to the conventional four colors; i.e., black, yellow, magenta and cyan. Further, the use of a so-called particular color ink such as red or blue ink has been proposed. In such a case, the ink jet printer must be provided with 7 to 8 ink tanks. Thereupon, a mechanism is necessary for preventing the respective ink tank from being mounted to an erroneous position. In Japanese Patent Application Laid-open No. 2001-253087, a structure is disclosed wherein the mutual engagement shapes between mounting portions of a carriage and the respective ink tanks are different from each other. Thereby, it is possible to prevent the ink tank from being mounted to an erroneous position.

In the above-mentioned Japanese Patent Application Laid-open No. 4-275156 (1992), a structure of an ink cartridge is disclosed, wherein an LED is attached to a printed circuit board (PCB) for carrying out the electric communication with a printer body. According to such a structure, however, it is necessary to dispose the PCB to a position at which the LED is easily visible by the user. In addition thereto, it is necessary to provide an electric connecting part in the PCB for the electric communication with the printer body. Therefor, there is a problem in that the degree of arrangement freedom of each of the LED and the electric connecting part is restricted. While it is thought to provide a large-sized PCB for covering both preferable positions for the electric connecting part and the LED, the production cost rises therefor. When the structure disclosed in Japanese Patent Application Laid-open No. 4-275156 (1992) is applied to the printer capable of mounting a plurality of independent ink tanks for the respective colors, a structure for mounting the ink tanks onto the printer is limited. Accordingly, it is necessary either to minimize a substantial volume of the respective ink tank or to enlarge a size of the printer.

On the other hand, while there is the disclosure in Japanese Patent Application Laid-open No. 2002-301829 in that an ink alarming lamp for the ink tank is provided at a place easily visible by the user, a preferable structure for supplying a power or signals to the ink alarming lamp is not described. FIGS. 6 to 8 thereof suggest that the ink jet printing apparatus and the ink alarming lamp are connected to each other by conductor wires. However, the conductor wires in correspondence to the number of the ink alarming lamps are necessary, which complicates the wiring arrangement not only to cause the production cost to rise but also to deteriorate the visibility of the lamps by the conductor wires or the connection thereof. Also, in FIGS. 6 and 7 of Japanese Patent Application Laid-open No. 2002-301829, a structure is disclosed in which the ink alarming lamp is provided on an attaching lever which is a movable member operative for attaching the ink tank on the carriage. In this case, however, the arrangement of the conductor wires is further complicated to cause the production cost to rise and also the attachment/detachment of the ink tank becomes difficult.

These problems have been further significant because the position at which the display is carried out to be visible by the user is preferably limited to the location or in the vicinity of operative means for the attachment/detachment of the ink tanks, due to the minimization in size or the multifunctioning of the printer. Particularly, in a multifunction printer carrying a scanner in the upper portion of the printer, the display position is more restricted whereby the visibility and the operability are further demanded.

The display is not only visible by the user but also used for the control carried out by the printer body. In this regard, the present inventors have known the following problems.

As described above, a structure wherein lamps are provided in ink tanks is described in Japanese Patent Application Laid-open No. 2002-301829. Even in this case, however, when the control section of the printer body recognizes an ink tank in which an amount of ink remaining therein is insufficient, it is necessary to specify such an ink tank to be supplied with a signal for the purpose of lighting the lamp based on such the recognition. For example, when the ink tank has been mounted at an erroneous position, there might be a possibility in that another ink tank in which a sufficient amount of ink remains is displayed as no ink remains therein. Accordingly, when light-emitting control of the display such as a lamp is carried out, it is necessary as a prerequisite to identify the position of the ink tank to be mounted.

As a structure for identifying the position of the ink tank, Japanese Patent Application Laid-open No. 2001-253087 describes that shapes of the mounting section and the ink tank to be engaged with each other are differentiated in every mounting positions. In this case, however, it is necessary to manufacture differently shaped ink tanks in correspondence to the respective ink colors or kinds, which is disadvantageous in production cost and/or efficiency on the recent trend that the number of ink tanks or kind of ink colors increases.

To solve such problems, the light-emitting control of individual LED is carried out in each of a plurality of ink tanks, based on an output state of a light receiver section fixed in the printer, to identify the position at which the ink tank is mounted. In such a structure, the LED in the ink tank has two functions for emitting a light beam to the user for informing the state of the ink tank and for emitting a light beam to the light receiver section to identify the position of the ink tank.

In this case, if an amount of emitted light is small, it may be difficult to be visible by the user although being sufficient for the light receiver section. Contrarily, if the amount of emitted light is excessively large, an error is liable to occur between the adjacent ink tanks, resulting in the difficulty in the correct identification of the ink tank. This is also true to the light receiver section in that it may receive the light not emitted from the correct ink tank but from that adjacent thereto.

Accordingly, it is preferable to employ a structure wherein the light emitted from the display section correctly reaches both the user and the light receiver section.

SUMMARY OF THE INVENTION

The present invention has been made in view of the above-mentioned technical background, and an object thereof is to obtain the information of a state in a liquid container with a favorable visibility without deteriorating the user's operability, through a liquid container simple in structure as well as low in production cost.

Another object of the present invention is to improve the visibility of the user and stabilize the operation of a light receiver section.

In a first aspect of the present invention, there is provided a liquid container for storing liquid used in an ink jet printing apparatus, comprising:

a display section for displaying information by emitting light, and a light emission limiting member disposed on the periphery of the display section.

In a second aspect of the present invention, there is provided a n ink jet printing apparatus having a light receiver section capable of being opposed to the display section, for carrying out the printing operation by using the above liquid container.

According to the present invention, it is possible to obtain a light volume favorable both for the improvement in the user's visibility in the display section and the operational stability in the light receiver section, by properly limiting a light volume emitted from the display section. Also, a structure is employed in which the light emitting source is separated from the display section and a light guiding section is provided on the liquid container for connecting the light therebetween. This makes it possible to obtain a structure for disposing the light emitting source and the display section at best positions, respectively, without needing the wiring for the power supply and the signal transmission/reception which interrupts the visibility and the operability of the user. Also, it is possible to ensure the degree of freedom for disposing the display section at a position at which the user's visibility is facilitated, whereby the user could obtain the predetermined information regarding the liquid container by viewing the light emitting state thereof.

The above and other objects, effects, features and advantages of the present invention will become more apparent from the following description of embodiments thereof taken in conjunction with the accompanying drawings.

DETAILED DESCRIPTION OF PREFERRED EMBODIMENTS

The present invention will be described below in more detail, with reference to the attached drawings illustrating the preferred embodiments.

1. Basic Structure

Figure 1A:
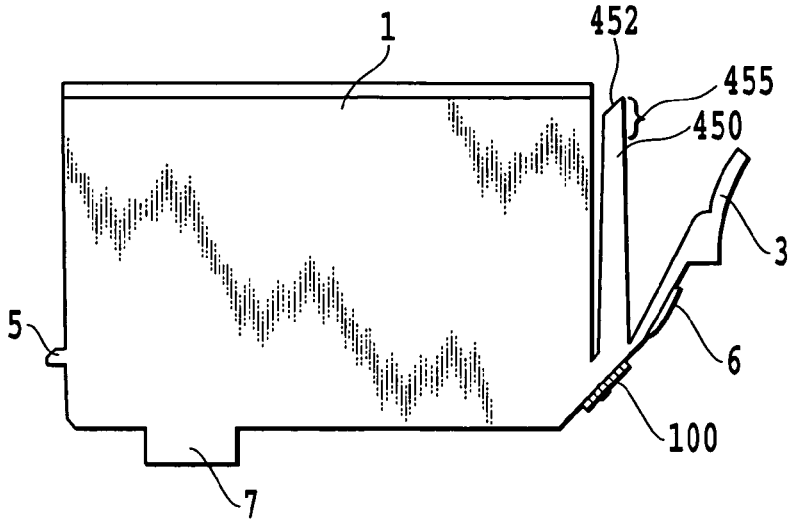
FIGS. 1A to 1C are a side view, a front view and a bottom view, respectively, of an ink tank according to a basic structure of the present invention.
Figure 1B:
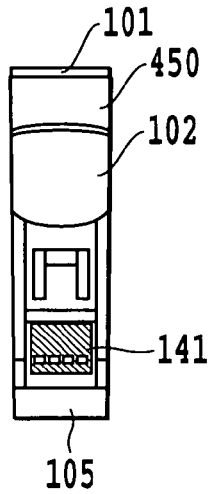
Figure 1C:
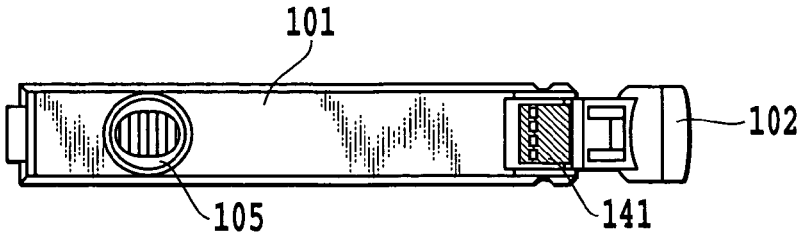

FIGS. 1A, 1B and 1C are a side view, a front view and a bottom view, respectively, of an ink tank which is a liquid container according to a basic structure of the present invention. In this regard, in the following description, a front surface of the ink tank is a surface opposed to the user, from which the manipulation of the ink tank such as an attachment/detachment thereof and the transmission of information to the user (the emission of light from a display section described later) are possible.

In FIGS. 1A to 1C, the ink tank 1 according to this embodiment has a supporting member 3 supported in a lower portion of the front surface. The supporting member 3 is formed of resin to be integral with an outer casing of the ink tank 1 so that it is movable about a supported portion, for example, when mounted to a tank holder described later. A first engagement section 5 and a second engagement section 6 (integral with the supporting member 3 in this embodiment) are provided on the rear and front sides, respectively, of the ink tank 1 so that the ink tank 1 is secured to the tank holder by the engagement thereof. The operation during the mounting will be described later with reference to FIGS. 5A to 5C.

On a bottom surface of the ink tank 1, an ink supply port 7 is provided to be coupled to an ink introduction port of a printing head described later when the ink tank is mounted to the tank holder. A substrate body is provided on the bottom surface side of a supporting part of the supporting member 3 at an intersection between the bottom and front surfaces. Although the substrate body may be of a chip shape or a plate shape, the following description will be made as a board 100.

A main structure and function of the embodiment according to the basic structure of the present invention will be described below. In this regard, FIGS. 2A and 2B are a schematic side view and an enlarged view of a main part thereof, respectively, for explaining a general function of a light guiding section disposed in the ink tank according to the basic structure of the present invention.

Figure 2A:
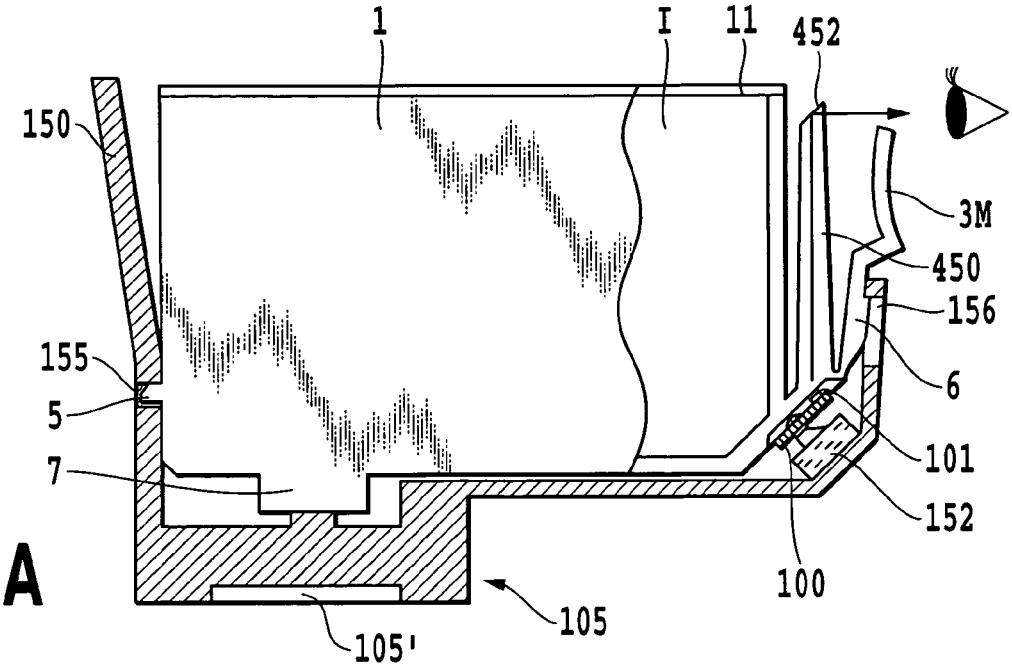
FIGS. 2A and 2B are a schematic side view and an enlarged view of a main part thereof, respectively, for explaining a general function of a light guiding section disposed in the ink tank shown in FIGS. 1A to 1C.
Figure 2B:
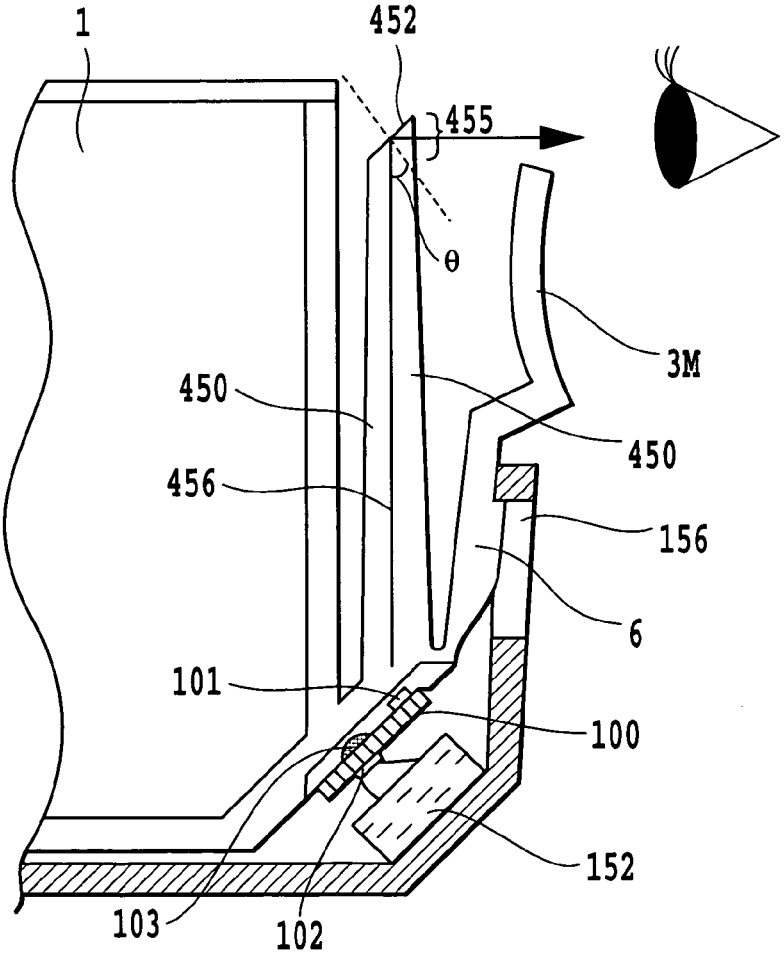

First, as shown in FIG. 2A, the first and second engagement sections 5 and 6 of the ink tank 1 are engaged with first and second fitting sections 155 and 156, respectively, of a holder 150 formed integral with a printing head unit 105 provided with a printing head 105'. Thereby, the ink tank 1 is mounted on the holder 150 and fixed thereto. At this time, a contact (hereinafter referred to as a connector) 152 provided on the holder 150 is brought into contact with an electrode pad 102 (see FIG. 2B) provided as a contact on a surface of the board 100 in the ink tank opposed to outside to make the electric connection.

The interior of the ink tank 1 is divided into an ink storage chamber 11 disposed on the front side and a negative pressure generating member storage chamber (not shown) disposed on the rear side to communicate with the ink supply port 7, wherein both the chambers are connected to each other. While ink I is directly stored in the ink storage chamber 11, an ink absorber impregnated with ink such as sponge or fiber aggregate (hereinafter conveniently referred to as a porous member) is accommodated in the negative pressure generating member storage chamber. The porous member generates a proper negative pressure in a range sufficient for preventing ink from leaking from an ink ejection orifice while being equilibrated with a force for holding a meniscus formed in an ink ejection nozzle of the printing head, as well as for allowing the ink ejection from the printing head.

In this regard, the interior structure of the ink tank is not limited to the above-mentioned one divided into the porous member storage chamber and the ink storage chamber. For example, substantially all the interior space of the ink tank may be filled with the porous member. Also, instead of using the porous member as means for generating negative pressure, a bag member made of elastic material such as rubber to generate a tension in the direction for increasing the volume may be filled with ink so that the negative pressure is applied to the ink therein due to the tension generated from the bag member. Further, at least part of the ink storage space may be formed of a flexible member, and this space is filled solely with ink. Under such conditions, a spring force is applied to the flexible member to generate a negative pressure.

A light emitting section 101 such as an LED for generating a visible light and a control element 103 for controlling the light emitting section are provided on a surface of the board 100 opposed to the inside of the ink tank 1. By an electric signal supplied from the connector 152 via the pad 102, the control element 103 controls the light emission of the light emitting section 101. In this regard, FIG. 2B illustrates a state wherein after the control element 103 is mounted to the board 100, the former is covered with a protective sealant. Also, when a memory element for storing information such as a color of ink stored in the ink tank or a remaining amount of ink is mounted, the former may be mounted to the same position and covered with the sealant.

Figure 3:
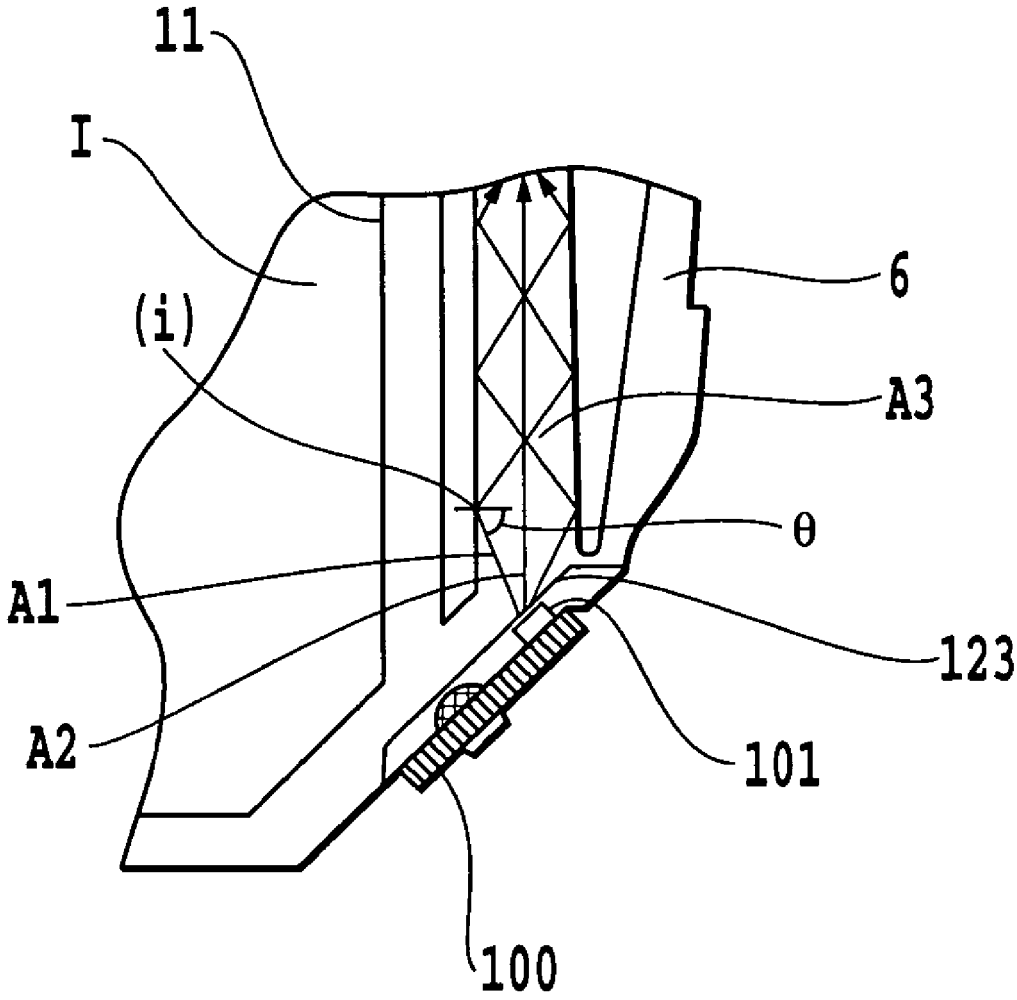
FIG. 3 is a schematic side view illustrating a part of the FIGS. 2A and 2B in a more enlarged manner.

As shown in FIGS. 2A, 2B and 3, a light guiding section 450 for guiding a light is provided upward from a portion opposed to the light emitting section 101 at a gap from a front wall of the outer casing of the ink tank. In the vicinity of a tip end portion of the light guiding section 450, there is a display section 455 on a front side thereof, which is favorably visible by the user. To suppress the reduction of light volume emitted from the light emitting section 101 to the light guiding section 450, the board 100 is disposed so that the light emitting section 101 is opposed to the vicinity of a light incident surface 123 of the light guiding section 450 (see FIG. 2B).

In such a manner, according to this embodiment, the light emitting section is separated from the display section, and the light guiding section 450 is provided in the ink tank 101, for optically connecting the both with each other. Thereby, it is possible to obtain a structure for arranging the light emitting section 142 and the display section 455 at the best positions, respectively, at a low cost without needing the wiring for the power supply and the signal transmission which may disturb the visibility and the operability of the user. Further, it is possible to secure the degree of freedom for the arrangement of the display section 455 at a favorable position ensuring the user's visibility, whereby the user can recognize the predetermined information regarding the ink tank 1 by viewing the light emitting state thereof. Also, if the light guiding section 450 is molded to be integral with the outer casing of the ink tank 1, the above advantage is obtainable without accompanied with a large increase in production cost.

Moreover, according to this embodiment, the light guiding section 450 is disposed so that an air layer is interposed between it and a front wall of the outer casing forming the ink storage chamber 11. While it may be thought to form the light guiding section integral with the front wall of the outer casing for the ink tank; that is, to use the front wall of the outer casing for the ink tank also as the light guiding section, the structure according to this embodiment is more efficient for guiding the light to the display section 455. The description in this respect is as follows:

In this embodiment, as shown in FIGS. 2A and 2B, the light guiding section 450 is integral with the outer casing of the ink storage chamber 106, but is formed independently from the front wall. That is, according to this embodiment, the air layer exists between the light guiding section 450 and the ink storage chamber 11. In this regard, the outer casing of the ink tank is formed of polypropylene. Accordingly, in this embodiment, if the light guiding section 450 is molded to be integral with the outer casing of the ink storage chamber 106, the material thereof is also polypropylene.

In this embodiment, as shown in FIG. 3, the light emitted from the light emitting section 101 is incident upon the light incident surface 123 of the light guiding section 450 which is an end surface of the latter and reaches the display section 455 for displaying the light to the user, via the light guiding section 450. Since the visible light which is a diffused light is employed as described before, the light emitting section 101 guides a plurality of light beams as shown by arrows A1 to A3.

Regarding the light guiding section 450, the refractive index of polypropylene is 1.49 (=n1). Since the refractive index of air is 1.00 (=n2), the critical refractive angle from polypropylene in this embodiment to air is approximately 43° in accordance with the following formula of a Snell's law:

$$n1 \times \sin \theta 1 = n2 \times \sin \theta 2$$

Accordingly, the light beams having the incident angle 43° or more are subjected to the total reflection on a boundary surface between the polypropylene (the light guiding section 450) and the air. As indicated by the arrow A1 or A3, the light beam reaches an inclined surface 452 formed at an upper end of the light guiding section while repeating the total reflections, and is reflected on the inclined surface to reach the display section 455. A position of the inclined surface 452 is on the rear surface side of the supporting member 3 and extends to a position higher than a manipulating section 3M. The inclined surface 452 is inclined so that a front side thereof is higher and a portion opposed to the front surface of the ink storage chamber 11 (a rear side) is lower.

Thus, when the light emitting section 101 emits light beams, the light beams are guided from a bottom end surface of the light guiding section 450 to the inclined surface 452 at the upper end and reach the display section 455 by being reflected on the inclined surface 452. To smoothly cause the light beams reflected on the inclined surface 452 to reach the display section 455, the inclination angle θ of the inclined surface 452 relative to an optical axis 456 is preferably determined to be the critical angle or more. That is, in this embodiment, as shown in FIG. 2B, the inclination angle (=an incident angle) θ relative to the optical axis is selected to be 43° or more, for example, 45° so that the condition of the total reflection is satisfied. Thereby, the light beams guided by the light guiding section 450 are subjected to the total reflection on the inclined surface 452 to reach the display section 455. Thus, the user's visibility is improved.

The predetermined information of the ink tank (a liquid container) 1 is as follows, for example:

whether or not the ink tank 1 is properly mounted (that is, whether or not the attachment thereof is complete);

whether or not the ink tank is disposed at a suitable position (that is, whether or not the ink tank is properly disposed at a predetermined position in correspondence to the ink color); and a remaining amount of ink.

These are informed to the user by ON or OFF of the light emission or a state of the light emission (repetition of ON and OFF).

Figure 4:
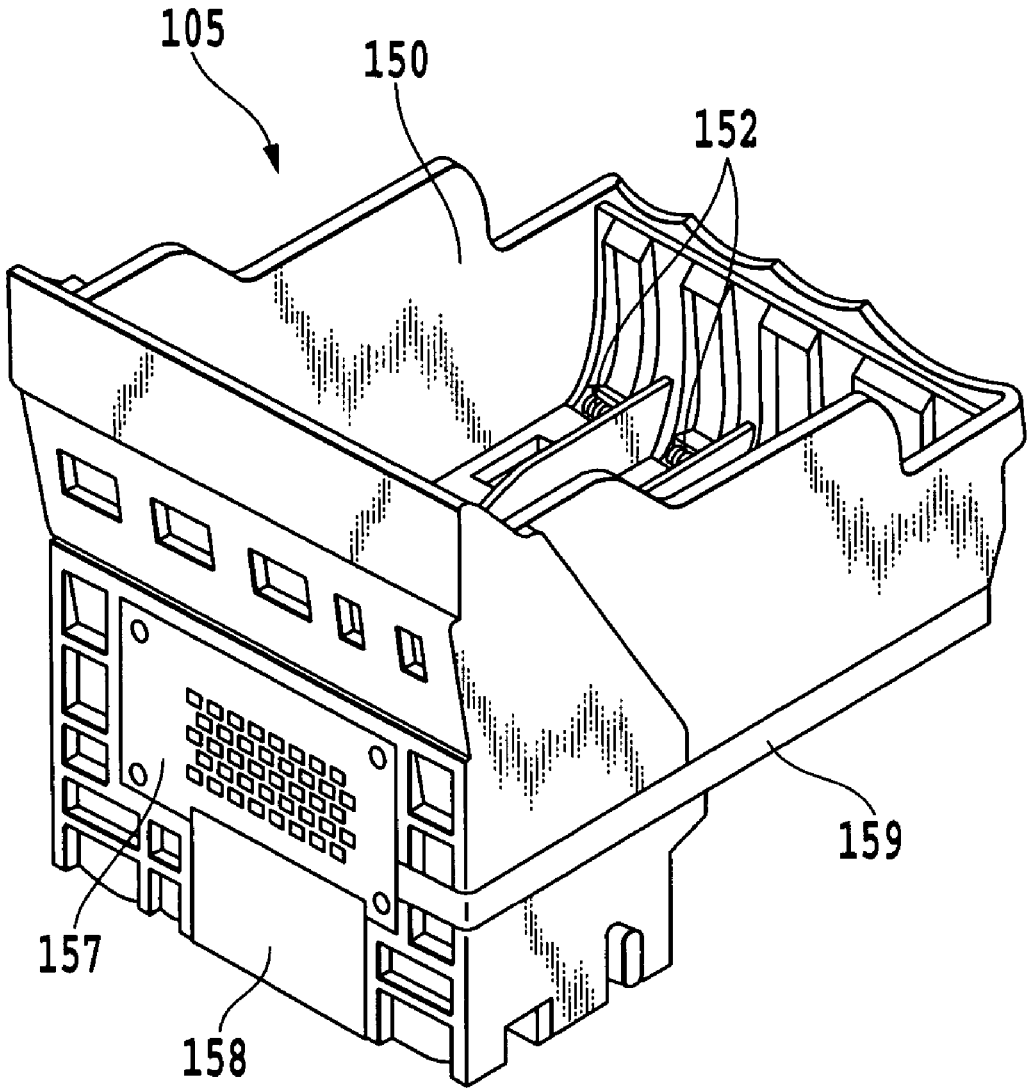
FIG. 4 is a perspective view of an embodiment of a printing head unit constructed so that the ink tank shown in FIGS. 1A to 1C is attachable to and detachable from it.
Figure 5A:
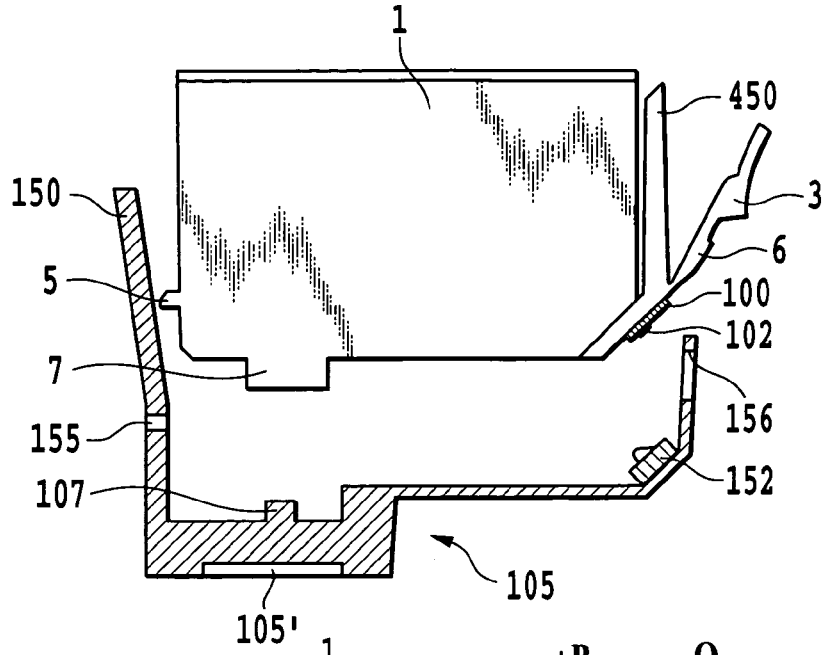
FIGS. 5A to 5C are views illustrating the operation when the ink tank is mounted to the printing head unit.
Figure 5B:
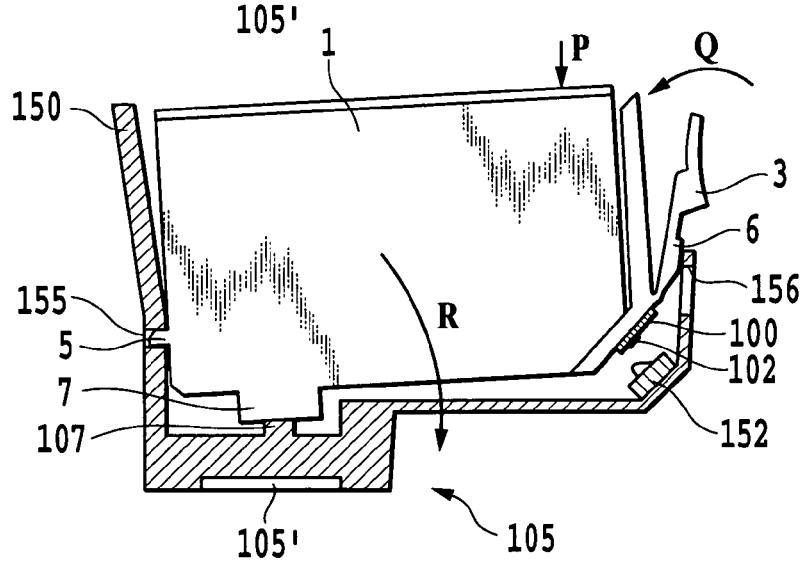
Figure 5C:
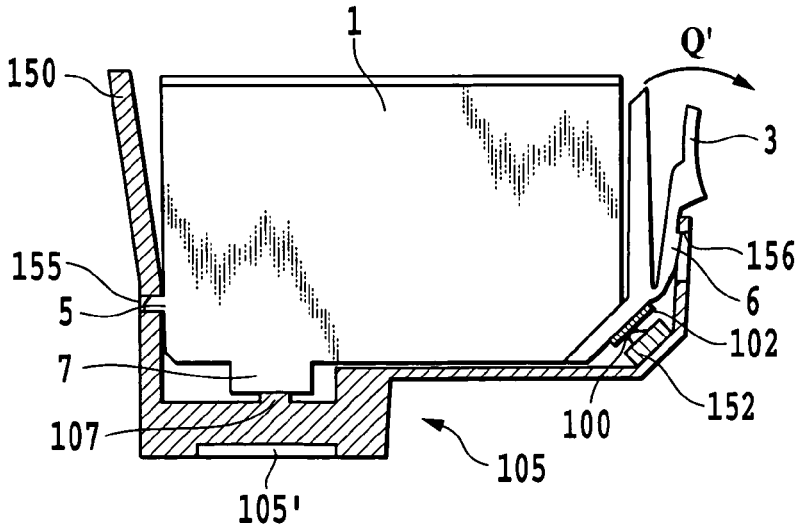

FIG. 4 is a perspective view of an embodiment of a printing head unit constructed so that the ink tank is attachable to and detachable from it; and FIGS. 5A to 5C are views illustrating the operation when the ink tank is mounted to the printing head unit. In this regard, the mounting section described here is applicable to other embodiments or modifications thereof described later.

The printing head unit 105 generally includes the holder 150 for holding a plurality (four in this drawing) of ink tanks in a detachable manner and a printing head 105' (not shown in FIG. 4) disposed on the bottom side. By mounting the ink tanks onto the holder 150, the ink introduction port 107 on the printing head side located on the bottom of the holder is coupled to the ink supplying port 7 on the ink tank to form an ink communicating path between the both.

The printing head 105' is provided with an electro-thermal transducer element in a liquid path constituting the nozzle. Particularly, the printing head of such a type may be used that the electro-thermal transducer element is supplied with electric pulses constituting printing signals, which are converted to thermal energy for heating ink, and a pressure upon the bubbling (boiling) of ink caused by the phase change thereof is used for the ejection of ink. Then, an electric contact section (not shown) for the signal transmission provided in a carriage 205 described later is brought into contact with an electric contact section 157 of the printing head unit 105 to transmit the printing signals to an electro-thermal transducer element driving circuit in the printing head 105' via a wiring section 158. A wiring section 159 also extends from the electric contact section 157 to the connector 152.

When the ink tank 1 is mounted to the printing head unit 105, the ink tank 1 is handled above the holder 150 (FIG. 5A). Then, the ink tank 1 is placed on the bottom of the holder while inserting the projected first engagement section 5 provided on the rear surface of the ink tank into the first fitting section 155 of a through-hole shape (Fog. 5B). In this state, when the front side upper end of the ink tank 1 is pushed in the direction indicated by an arrow P, the ink tank 1 rotates about a point at which the first engagement section 5 is engaged with the first fitting section 155 in the direction indicated by an arrow R, whereby the front side of the ink tank moves downward. During this process, the second engagement section 6 provided in the supporting member 3 on the front side of the ink tank is pushed by the second fitting section 156 provided on the front side of the holder to move the supporting member 3 in the direction indicated by an arrow Q.

When the upper surface of the second engagement section 6 reaches below the second fitting section 156, the supporting member 3 deforms in the direction indicated by an arrow Q' due to its own elasticity, whereby the second engagement section 6 is engaged with the second fitting section 156. In this state (FIG. 5C), the second engagement section 156 elastically biases the ink tank 1 in the horizontal direction via the supporting member 3 to bring the rear surface of the ink tank 1 into contact with the rear surface of the holder 150. The upward movement of the ink tank 1 is restricted by the first fitting section 155 engaged with the first engagement section 5 and the second fitting section 156 engaged with the second engagement section 6. Thus, the ink tank 1 has been mounted to the printing head unit 105, wherein the ink supply port 7 is connected to the ink introduction port 107 and the pad 102 is brought into contact with the connector 152.

Figure 6:
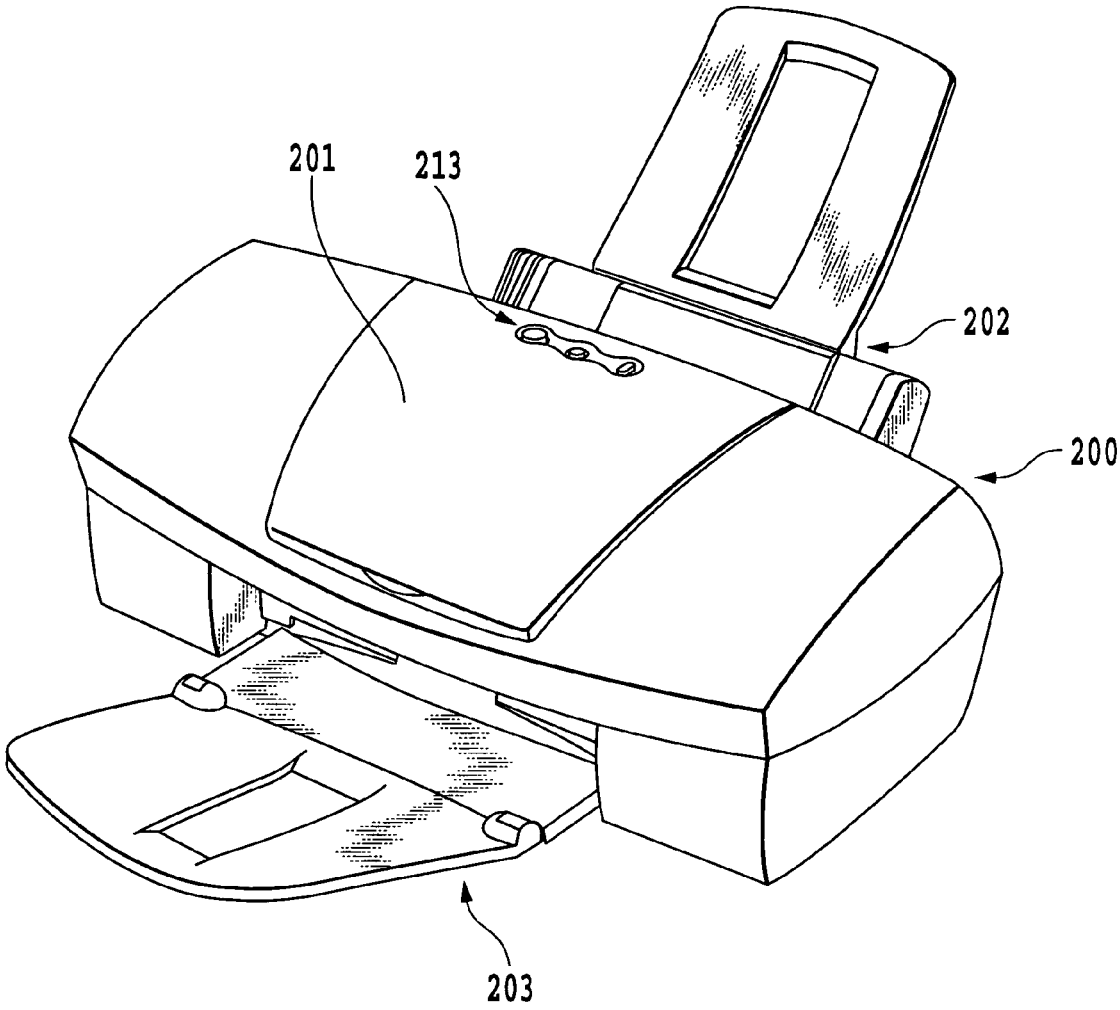
FIG. 6 is a perspective view illustrating an appearance of an ink jet printer carrying out the printing operation while mounting the ink tank.

FIG. 6 illustrates an appearance of an ink jet printer 200 carrying out the printing operation while mounting the ink tank described above; and FIG. 7 is a perspective view thereof wherein a body cover 201 shown in FIG. 6 is open. In this regard, this printer described below is also applicable to the respective embodiments or modifications described later.

As shown in FIG. 6, the printer 200 includes a printer body. In the printer body, a main part is covered with a body cover 201 and other casings, and carries out the printing operation by driving a carriage mounting a printing head and an ink tank thereon to move for the purpose of scanning. A sheet discharging tray 203 and an automatic sheet feeder (ASF) 202 are provided on front and rear sides, respectively, of the printer body. Also, there is provided a manipulating section having an indicator showing the conditions of the printer both when the body cover is closed and opened, a power source switch and a reset switch.

Figure 7:
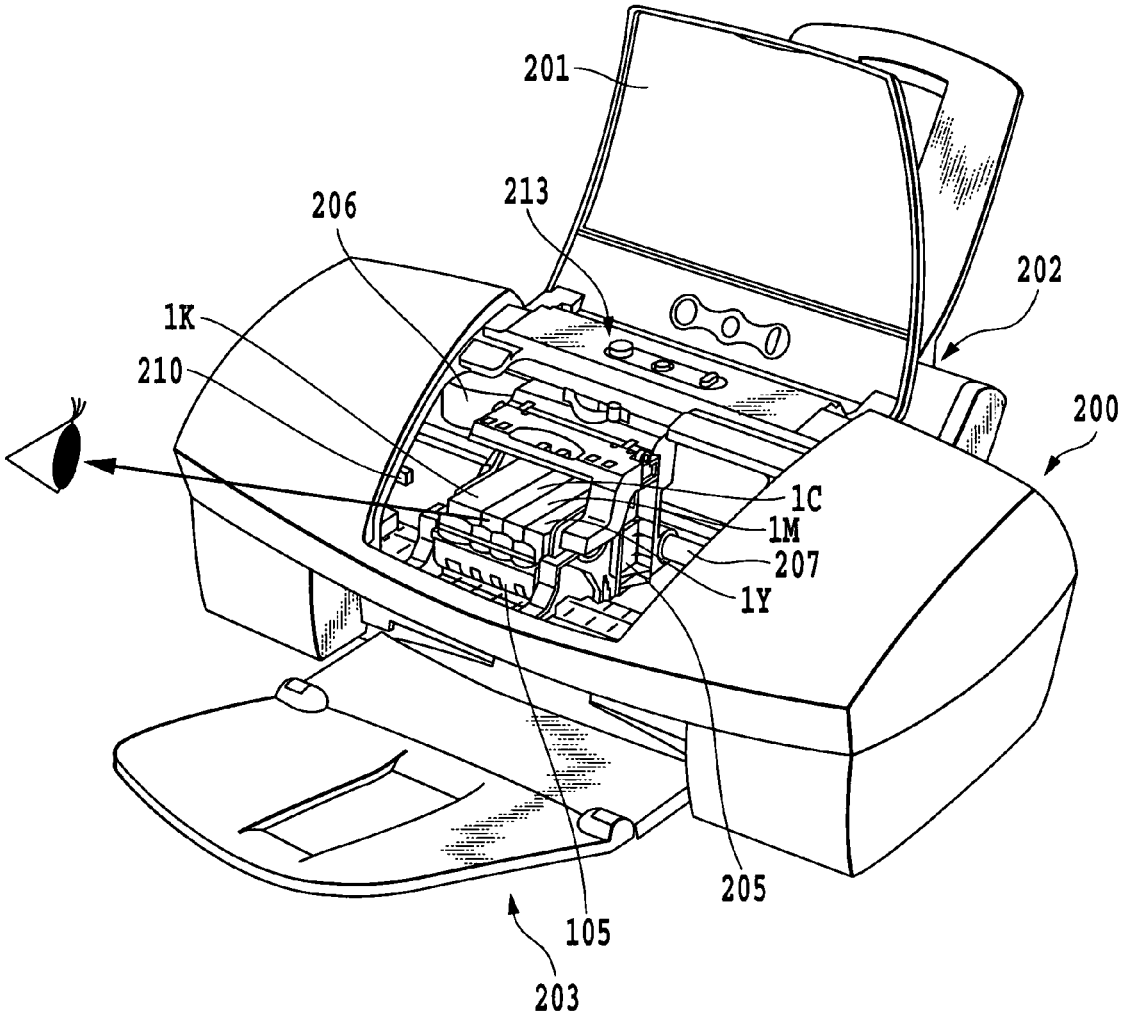
FIG. 7 is a perspective view of the printer shown in FIG. 6, from which a body cover is removed.

In the opening state of the body cover 201, as shown in FIG. 7, the user can look round a range in which the carriage 205 mounting the printing head unit 105 and the ink tanks 1K, 1Y, 1M and 1C and the periphery thereof. Hereinafter, these ink tanks may be denoted by the same reference numeral "1". In practice, when the body cover 201 is open, a sequence for automatically moving the carriage 205 to a generally central position shown in the drawing (hereinafter referred to as "a tank-replacement position") is executed, and the user can carry out the replacement of the individual ink tanks at this position.

The printer of this embodiment uses the printing head unit 105 provided with chip-shape printing heads (not shown) in correspondence to the respective color inks. The printing head of the respective color scans a printing medium such as paper by the movement of the carriage 205, during which ink is ejected to the printing medium to execute the printing operation. That is, the carriage 205 is engageable in a slidable manner with a guide shaft 207 extending in the moving direction thereof and is movable as described above by means of a carriage motor and a transmission mechanism thereof. In the respective printing heads corresponding to inks of K, Y, M and C, the ink is ejected based on the ejection data fed from a control circuit in the printer body via a flexible cable 206. Also, a sheet feeding mechanism such as a sheet feeding roller or a sheet delivery roller is provided to convey a printing medium (not shown) fed from the automatic sheet feeder to the sheet discharging tray 203. The printing head unit 105 integral with the ink tank holder is detachably mounted to the carriage 205, while the respective ink tanks 1 are detachably mounted to this printing head unit 105.

In the printing operation, the printing head carries out the scanning motion in accordance with the above-mentioned movement, during which ink is ejected from the respective printing head to the printing medium to execute the printing operation in an area having an effective width (orthogonal to the main scanning direction of the printing head) corresponding to an arrangement range of ejection orifices in the printing head. The sheet is fed at a predetermined distance equal to or less than the above width between this scanning and the next scanning by the sheet feeding mechanism, whereby the sequential printing operations are carried out on the printing medium. Also, an ejection recovery unit such as a cap for covering a surface on which the ejection orifices are arranged in the respective printing head is provided at an extremity of the movement range of the printing heads resulting from the carriage motion. Thereby, the printing heads move to a position at which the ejection recovery unit is provided at a predetermined time interval and are subjected to the recovery treatment such as a preliminary ejection.

As described before, the connector is provided in correspondence to the respective ink tank in the printing head unit 105 having the tank holder section for the respective ink tank, and brought into contact with the pad 102 on the board 100 provided in the mounted ink tank 1. Thereby, it is possible to carry out the lighting or ON/OFF control of the respective light emitting section in accordance with a predetermined sequence executed by the printing apparatus. Thus, the information regarding the state of the ink tank can be known.

Concretely, at the above-mentioned tank-replacement position, if the remaining amount of ink is insufficient in the ink tank 1, the light emitting section 101 of the ink tank 1 in question is lighted or blinked, whereby it is visible by the user via the light guiding section 450 and the display section 452. As another example of the control in the light emitting section, it is also possible to light the light emitting section of the ink tank 1 in question if it is properly mounted to the tank-replacement position to be visible by the user via the light guiding section 450 and the display section 452. These controls are executed by transmitting control data (control signals) from the control circuit in the printer body to the respective ink tank via the flexible cable 206 in a similar manner as in the control of the ink ejection from the printing head.

Further, it is possible to provide a light receiver section 210 having a light receiving element in the vicinity of an end of the moving range of the carriage opposite to a position at which the above-mentioned recovery unit is provided. Thereby, when the display section 452 of the respective ink tank 1 passes by the light receiver section during the movement of the carriage 205, the light emitting section 101 emits the light which is received by the light receiver section via the light guiding section 450 and the display section 452. Accordingly, based on the position of the carriage 205 at which the light is received, it is possible to detect whether or not the respective ink tank 1 is mounted to the carriage 205, or whether or not it is mounted to a correct position. That is, the display section 452 serves not only for improving the user's visibility but also for facilitating the detecting operation or the control executed by the printing apparatus. In this regard, a more favorable structure for achieving both the advantages will be described in the following embodiment.

2. First Embodiment of Characteristic Structure

The user strongly desires to correctly identify the ink tank from which display section are emitted light. If the light volume emitted therefrom is excessively small, it is difficult to be seen. Contrarily, if excessively large, the erroneous identification is liable to occur between adjacent ink tanks. This is also true to the light receiver section in that it may receive the light not emitted from the ink tank in question but from that adjacent thereto.

Accordingly, it is desirable to employ such a structure that the light emitted from the display section favorably reach the user and the light receiver section. Such a structure will be described below.

Figure 8:
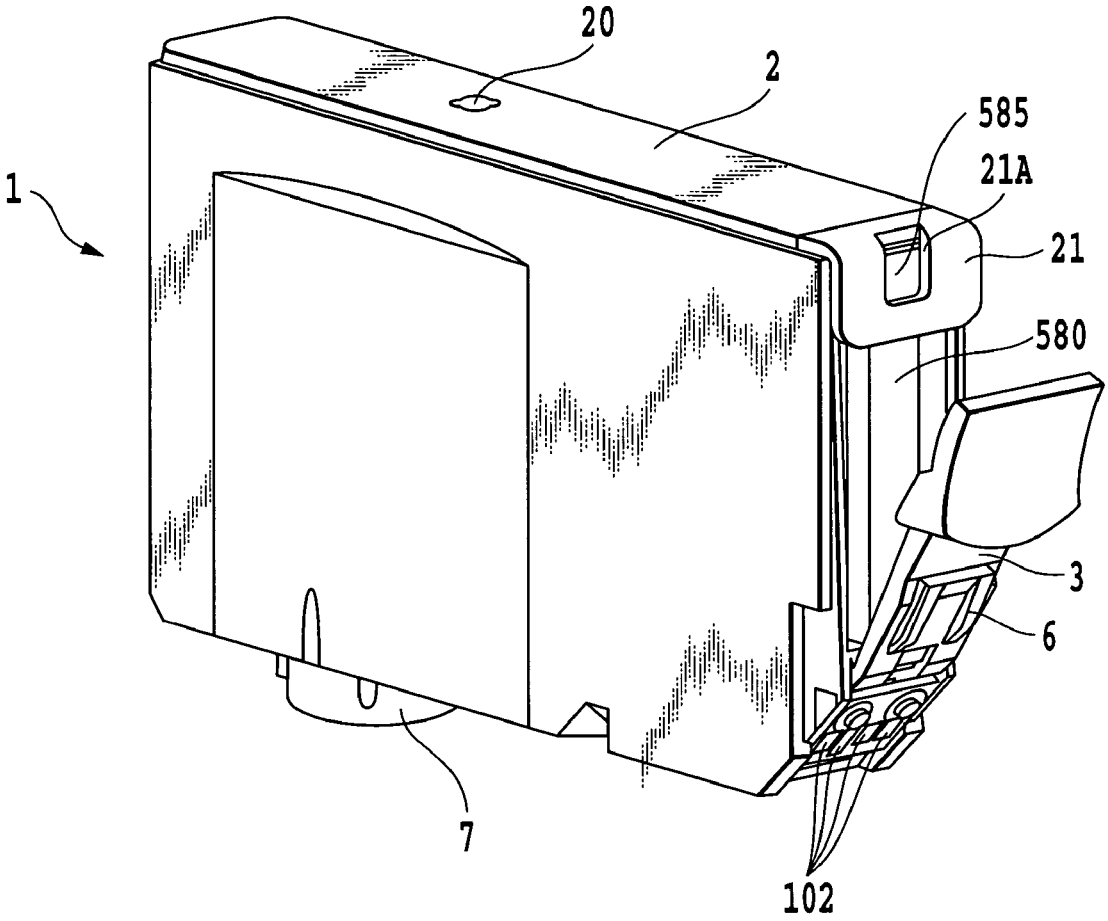
FIG. 8 is a perspective view of an ink tank employing a characteristic structure of the present invention.
Figure 9E:
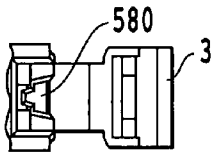
FIGS. 9E and 9F are a top view and a front view, respectively, of the ink tank, from which a cover member is removed.
Figure 9F:
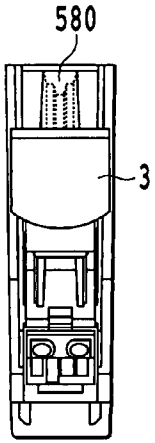
Figure 9D:
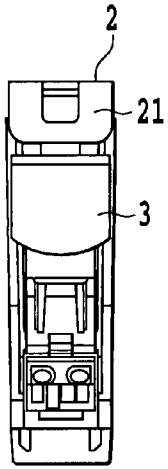
FIGS. 9A, 9B, 9C and 9D are a side view, a top view, a bottom view and a front view, respectively, of the ink tank shown in FIG. 8.
Figure 9B:
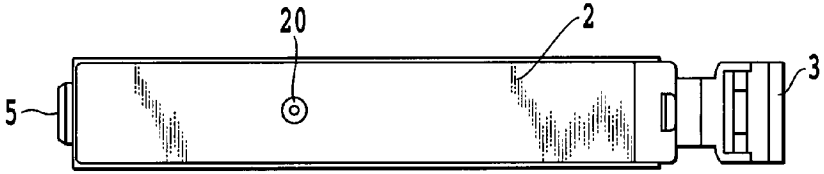
Figure 9A:
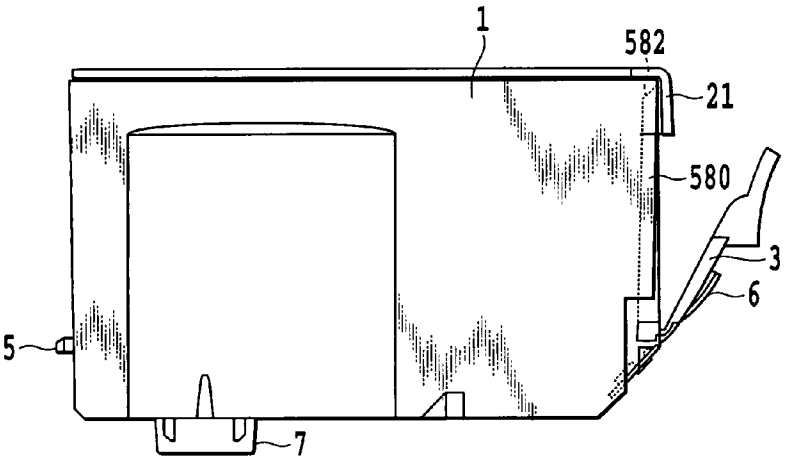
Figure 9C:
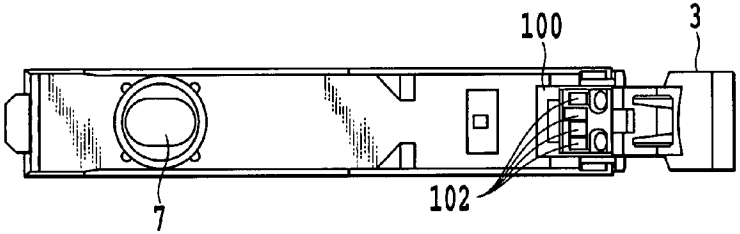

FIG. 8 is a perspective view of an ink tank employing a characteristic structure of the present invention in addition to the above-mentioned basic structure, FIGS. 9A, 9B, 9C and 9D are a side view, a top view, a bottom view and a front view, respectively, of the ink tank shown in FIG. 8; and FIGS. 9E and 9F are a top view and a front view, respectively, of the ink tank, from which a cover member is removed.

This embodiment basically has substantially the same structure as shown in FIGS. 1A to 1C. That is, a light guiding section 580 having an inclined surface 582 stands upward at a position opposed to the light emitting section 101 so that the light is emitted from a part disposed on the upper front side thereof, defining a display section 585. According to this embodiment, a light emission limiting member 21 having a predetermined opening 21A is provided opposite to the display section 585, while covering the periphery of the display section 585.

Reference numeral 2 denotes a cover member attached to the top surface of the ink tank 1, for covering the interior of the ink tank 1 as well as for communicating the interior with outer air through an opening 20. In this embodiment, the light emission limiting member 21 may be made, for example, of thermoplastic elastomer and integrally fusion-bonded to the cap member 2. In this regard, since the thermoplastic elastomer is transparent, it may be colored by adding color pigment thereto for the purpose of decreasing the light emission from the periphery to stabilize the light receiving operation of the light receiver section 210 as well as to improve the user's visibility. Instead, the light emission limiting member 21 may be made of other material than the elastomer, or may be molded with the same material as the cap member 2 as an integral piece. If the cover member 2 is formed of transparent material, at least one of front and rear surfaces of part forming the light emission limiting member 21 may be roughened or subjected to a blast treatment or coated with paint so that the light emission is restricted.

According to this embodiment, it is possible to provide a picture-frame like contrast around the outer periphery of the display section by suitably limiting the light-emission from the display section, resulting in a favorable light volume for both of the improvement in user's visibility and the stabilization of the operation. The light emission limiting member 21, as far as it can provide the contrast, may have any structure. However, in order to suitably restrict the light emission from the above stated outer periphery and emit the light only through opening 21A, it is preferred to form the light emission limiting member 21 with a light shielding material that substantially does not transmit light.

By the way, it is desirable that the light is emitted from the display section to a range as wide as possible because the user might see the display section of the ink tank in the interior of the printer at various angles in accordance with the arrangements or others of the printer. On the other hand, since the display section is used not only for facilitating the user's visibility but also for the detection and control of the ink tank carried out by the printer, the light receiver section 210 is provided in the interior of the printer (see FIG. 7).

For example, while the carriage 205 scans relative to the light receiver section 210, the respective ink tanks or the display sections thereof sequentially pass by the light receiver section 210. In this process, it is possible to detect whether or not the ink tank of the respective color is mounted to a proper position at which it is ought to be attached. That is, the light emitting section of the ink tank storing color ink in question is made to emit light at a timing at which a certain ink tank is to be opposed to the light receiver section 210. If the light receiver section 210 receives the light at that time, it is determined that the latter ink tank is correctly arranged in a group of the ink tanks, and contrarily, if the light receiver section 210 receives no light, it is determined that the latter ink tank is erroneously arranged in the group of the ink tanks. In the latter case, the printing operation is prohibited, for example, to give the attention to the user to open the body cover 201 (see FIG. 6) and to blink he light emitting section or the display section of the incorrectly attached ink tank so that the remounting to the proper position is induced. Thereby, it is possible to avoid the inconvenience in that the color regeneration is disturbed due to the mismounting of the ink tank or in that the ink tank having an insufficient remainder of ink is not displayed but that having a sufficient remainder of ink is displayed.

Since the light receiver section 210 used for the detection and control of the ink tank described above is fixed in the interior of the printer relative to the scanned ink tank mounted to the carriage, the positional relationship thereof to the display section of the ink tank during the detection is maintained constant. Thereby, different from a case wherein the display section is seen by the user, it is necessary to increase the density of the light by concentrating the light emission into an area as narrow as possible within the attachment accuracy upon fixing the light receiver section to the printer so that the light volume going to the light receiver section is stably ensured.

That is, the contradictory demands are required to the display section for satisfying the two functions. Accordingly, in this embodiment, a structure for further improving the user's visibility and stabilizing the light receiving volume is employed.

Figure 10B:
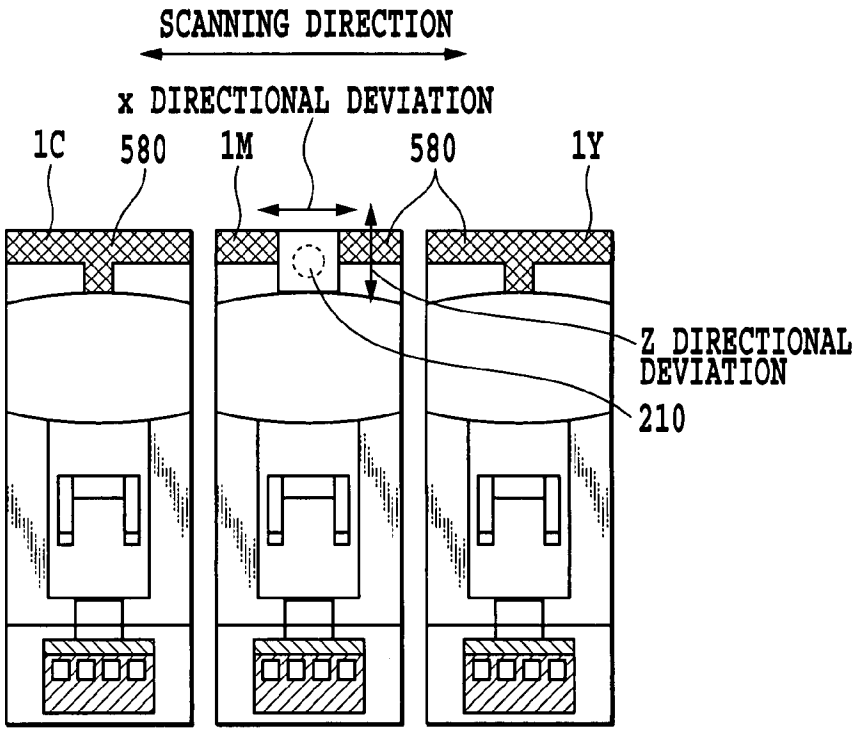
FIG. 10B is a schematic front view illustrating a state wherein the above-mentioned group of ink tanks is opposed to a light receiving section disposed in the printer by the movement of a carriage.
Figure 10A:
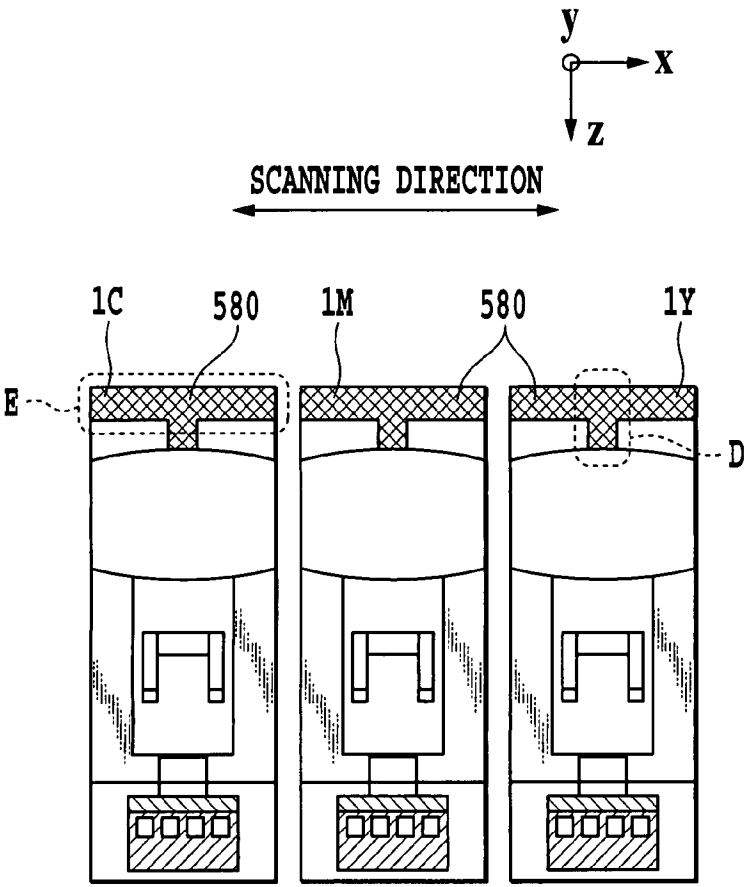
FIG. 10A is a schematic front view illustrating a state wherein a plurality of ink tanks shown in FIG. 8 are mounted to the printer.
Figure 11:
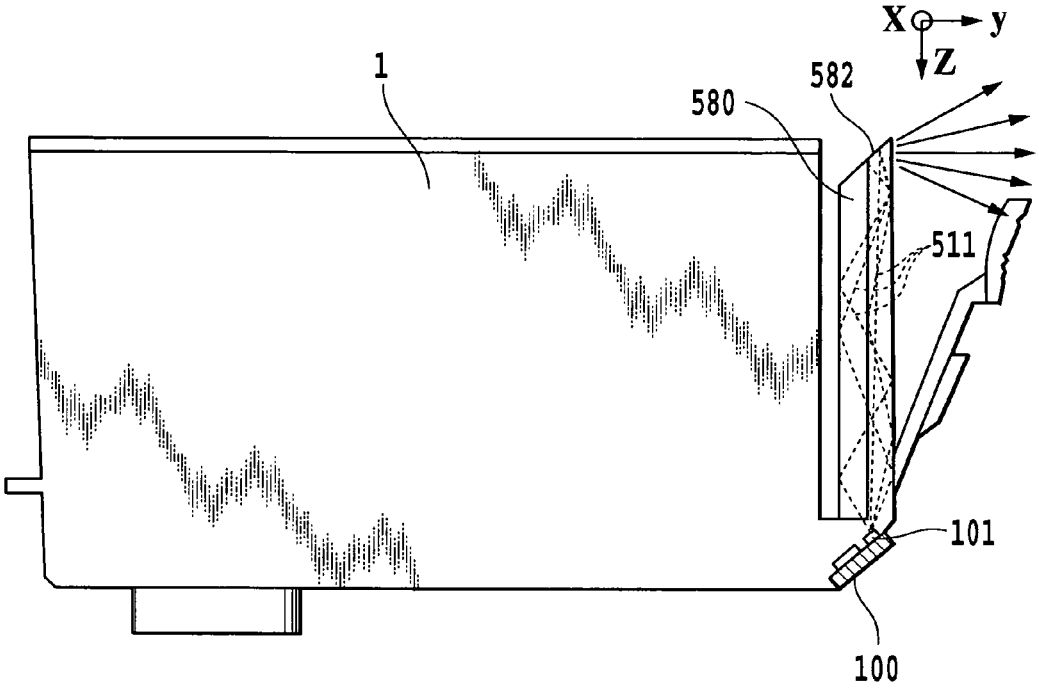
FIG. 11 is a schematic side view illustrating a state of a light from the incidence thereof into a light guiding section shown in FIG. 8 to the emission of the light from the light guiding section.
Figure 12B:
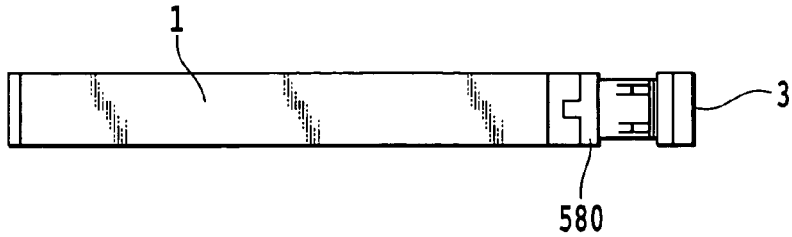
FIGS. 12A, 12B, 12C and 12D are a side view, a top view, a bottom view and a front view, respectively, according to another embodiment of an ink tank employing a characteristic structure of the present invention.
Figure 12A:
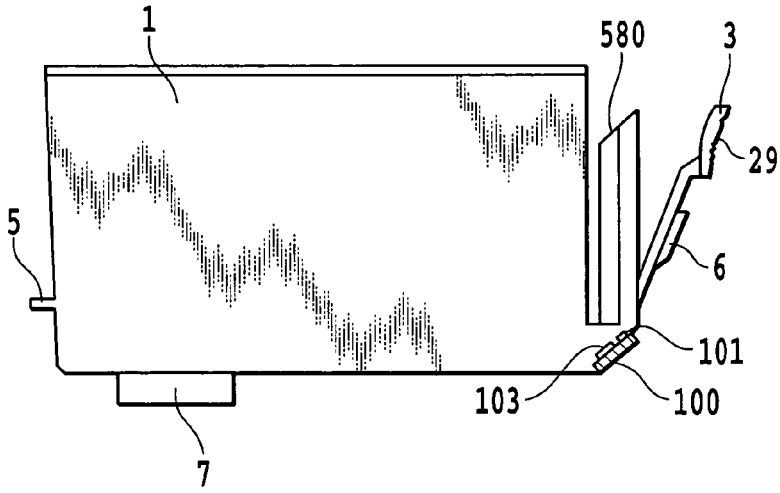
Figure 12D:
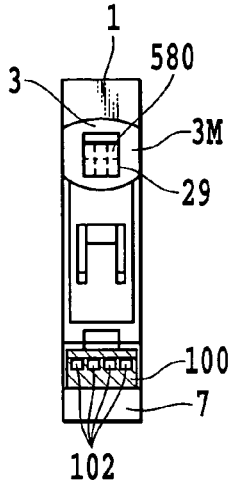
Figure 12C:
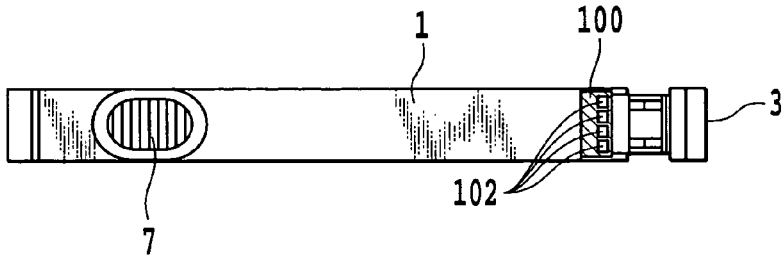

FIG. 10A is a schematic illustration of a printer mounting a plurality of ink tanks 1 shown in FIG. 8 as seen from the front side, wherein a cyan tank 1C, a magenta tank 1M and a Yellow tank 1Y are particularly picked up. FIG. 10B illustrates a state wherein the light receiver section is opposed to the display section of the magenta tank 1M in the above arrangement. Further, FIG. 11 is a side view of the ink tank 1 for explaining the function of the light guiding section in this embodiment. In this regard, in these drawings, the light guiding section 580 and the display section 585 are exaggeratedly depicted and the cover member 2 and the light emission limiting member 21 are eliminated.

The light guiding section 580 in this embodiment has a generally T-shaped cross-section consisting of a region extending in the scanning direction and a region extending vertically thereto as seen in the z direction (from above) (FIG. 11). In FIG. 10A, a shape of the light guiding section 580 cut with the inclined surface 582 can be seen. This shape is also a generally T-shape consisting of a region E extending in the scanning direction (x direction) and a region D extending vertically thereto (z direction) as seen from the front side.

The light emitting section 101 is disposed at a bottom end of the light guiding section 580 opposed to an intersection of the two region forming the generally T-shape. When the light beams emitted from the light emitting section 101 are incident upon the light guiding section 580, they are guided within the light guiding section 580 as indicated by broken lines 511 in FIG. 11, reflected on the inclined surface 582, and emitted forward (rightward in FIG. 11) from the front side of the ink tank.

The positional relationship of the light receiver section 210 fixed in the printing apparatus to the respective ink tank may be variable due to the mounting tolerance thereof. That is, in FIG. 10B, the deviation may occur in the carriage scanning direction (x direction), the direction vertical thereto (y direction) and the direction orthogonal to the paper surface (z direction) in FIG. 10B. However, according to this embodiment, it is possible to correctly detect the ink tank and know whether or not it is properly mounted or positioned while allowing the deviation in the respective direction, by the special shape of the light guiding section 580.

In this embodiment, the light receiver section 210 is disposed to receive the light emitted forward (in the y direction). Accordingly, the deviation in the y direction changes the distance from a position from which the light is emitted to the light receiver section 210, resulting in the variation of detected intensity of the light emitted from the display section 585. However, if a proper threshold value is determined for allowing the change of the light volume within the tolerance, it is possible to correctly detect the ink tank while allowing the deviation of the light receiver section 210 in the y direction.

Also, the deviation in the x direction is allowable by continuously receiving the light radiated from the light emitting section 101 of the ink tank 1 and emitted out from the display section 585 by the light receiver section 210 while subjecting the carriage to the scanning motion. Even if there is the deviation in the light receiver section in the x direction, it is possible to correctly carry out the detection of the ink tank by emitting or receiving the light within a range matching with the deviation. A curve of the variation in the light volume received by the light receiver section 210 has a maximum value (peak) due to the existence of the region D. By knowing the detection instant of this peak and adjusting the light emission timing of the light emitting section 101 for the next detection or later, it is possible to correct the deviation in the x direction.

Further, if a length of the region D in the z direction as seen from a front side is larger than the tolerance of the mounting position of the light receiver section 210 in the z direction, it is possible to receive the light from the display section 585. Thereby, the deviation of the light receiver section 210 in the z direction is allowable and the detection of the ink tank is correctly carried out. In this regard, the shorter the length of the region D, the higher the density of the light emitted from the display section 585 to increase the light volume received by the light receiver section 210, whereby it is possible to assuredly detect the ink tank without the disturbance from outer light. Accordingly, the length of the region D may be suitably designed based on the tolerance of the mounting position of the light receiver section 210 and a favorable light volume to be received by the light receiver section 210.

On the other hand, the display section 585 operates to light or blink to be visible by the user when an amount of ink in the ink tank is insufficient. Accordingly, it is desirable that the light emission area is as wide as possible to be visible by the user from various positions or angles. For this purpose, in addition to the region D which dimension and shape are designed mainly to facilitate the detecting operation of the light receiver section, those of the region E are suitably designed so that the light emission area sufficiently spreads. That is, the display section 585 extends in the widthwise direction of the ink tank 1 to secure the wide emission of the light in the widthwise direction. Thereby, it is possible to widen the area visible by the user to further facilitate the visibility.

In this regard, while the light guiding section in this embodiment has a generally T-shaped cross-section, the shape and dimension thereof should not be limited thereto provided the favorable light emission is obtainable at the upper end 552 forming the display section. The upper end may be of a shape other than a generally T-shape. The characteristic structure of the present invention aims to suitably limit the light emission from the display section, and to obtain a favorable light volume both for the user's visibility in the display section and for stabilizing the operation of the light receiver section. The employment of the above-mentioned shape is not indispensable. That is, the cross-sectional shape of the light guiding section and a portion for emitting the light may be simpler such as rectangular or circular. This is true to a second embodiment described below.

3. Second Embodiment of Characteristic Structure

Figure 13B:
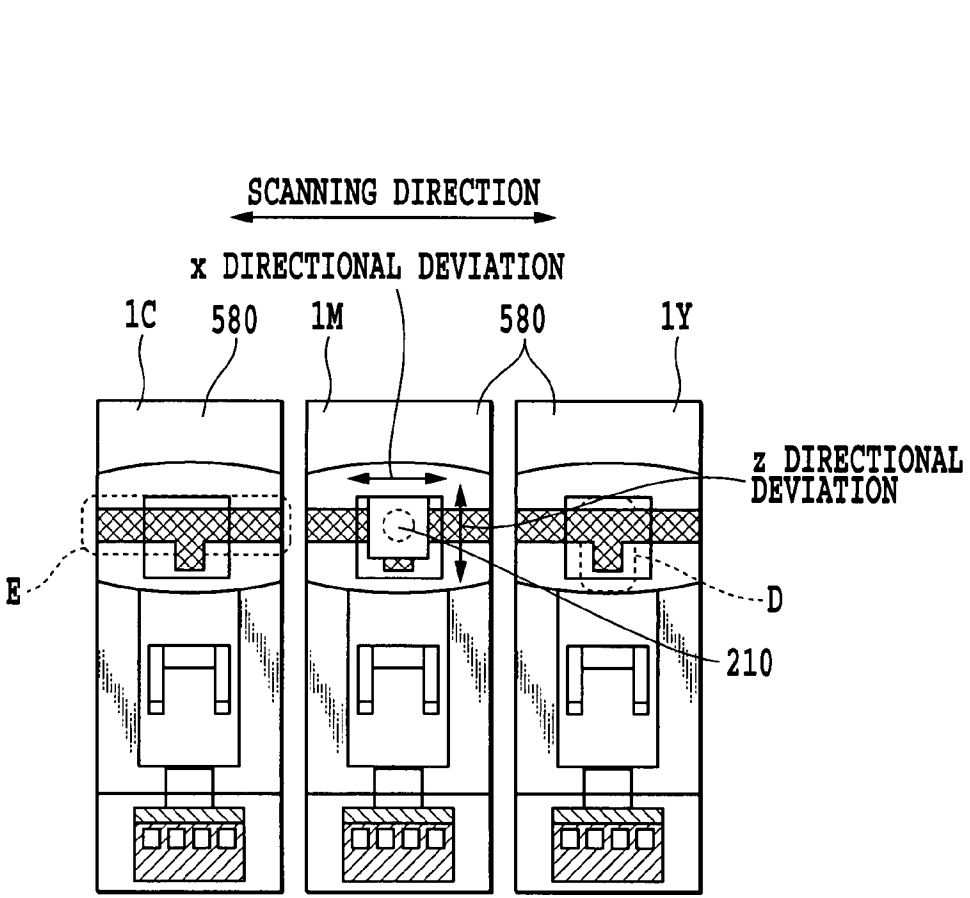
FIG. 13B is a schematic front view illustrating a state wherein the above-mentioned group of ink tanks is opposed to a light receiving section disposed in the printer by the movement of a carriage.
Figure 13A:
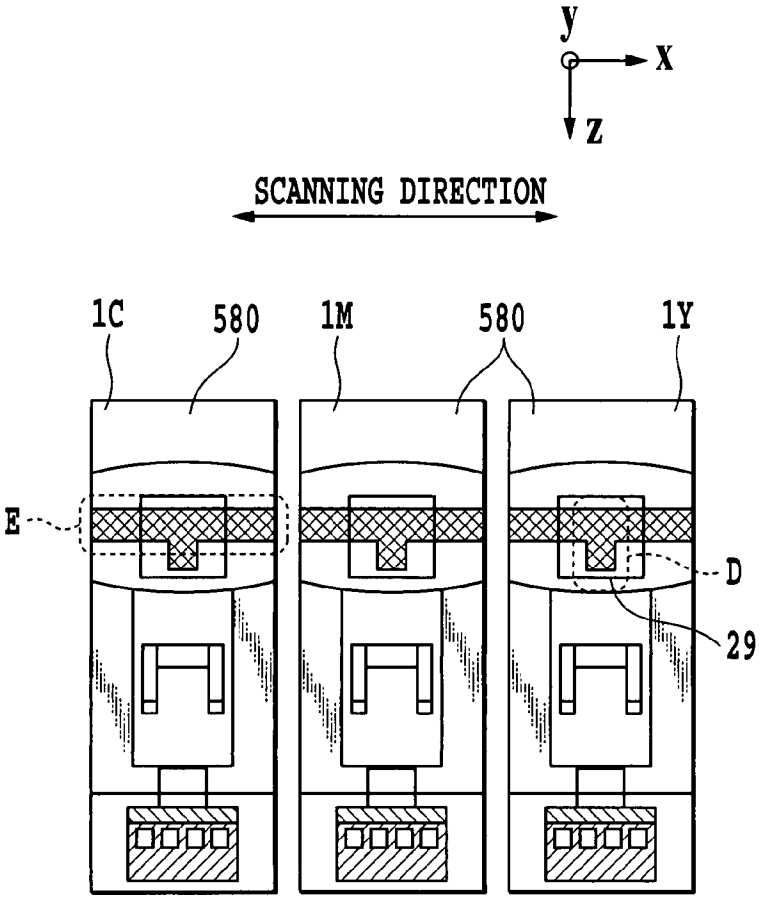
FIG. 13A is a schematic front view illustrating a state wherein a plurality of ink tanks shown in FIGS. 12A to 12D are mounted to the printer.
Figure 14:
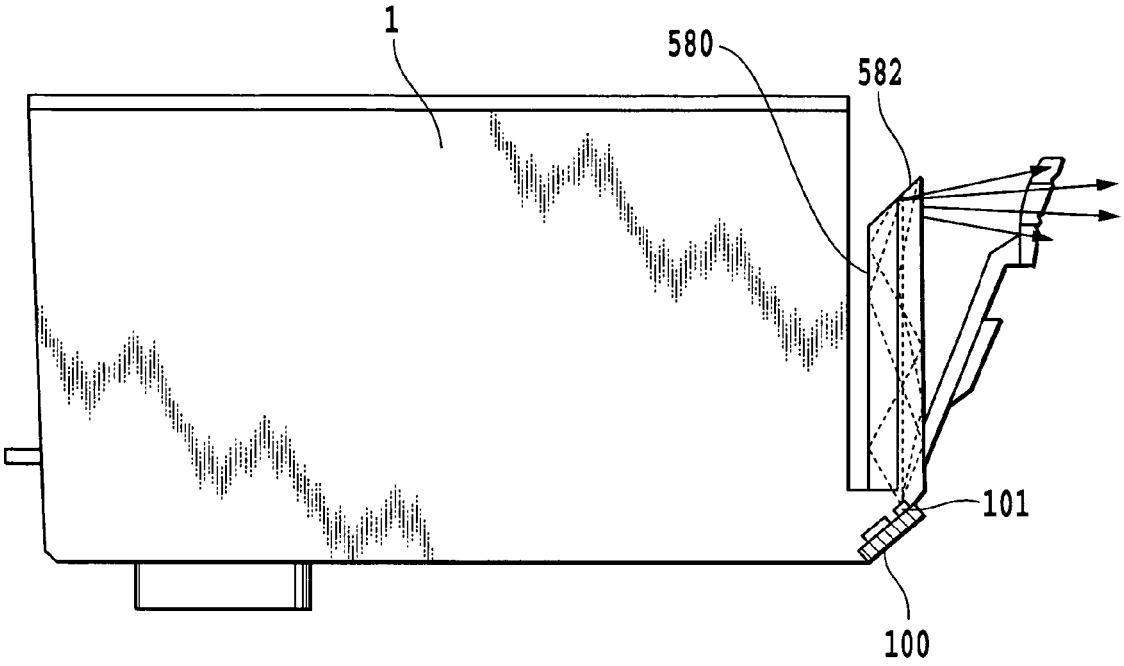
FIG. 14 is a schematic side view illustrating a state of a light from the incidence thereof into a light guiding section shown in FIGS. 12A to 12D to the passage of the light through a display section.

FIGS. 12A, 12B, 12C and 12D are a side view, a top view, a bottom view and a front view, respectively, of a second embodiment according to the characteristic structure. FIG. 13A is a schematic illustration of a printing apparatus on which are mounted a plurality of ink tanks 1 shown in FIGS. 12A, 12B, 12C and 12D, while selecting a cyan tank 1C, a magenta tank 1M and a yellow tank 1Y as representatives. FIG. 13B illustrates a state in which the light receiver section is opposed to the display section of the ink tank 1M for the magenta ink in the arrangement shown in FIG. 13A. Further, in these drawings, the light guiding section 580 and the display section 585 are exaggeratedly depicted.

In the first characteristic structure, it is devised to emit the light from an upper part of the light guiding section 580 in which the light emission limiting member 21 is provided to define the display section. Contrarily, according to this embodiment, a height of the light guiding section 580 is lower than that in the first embodiment so that the inclined surface 582 is positioned on the rear side of the manipulating section 3M of the supporting member 3. An opening 29 is provided in part of the manipulating section 3M, through which the light reflected on the inclined surface 582 of the light guiding section 580 and emitted from the upper part thereof is visible by the user or received by the light receiver section. In other words, in this embodiment, the manipulating section 3M operates as a light emission limiting member and the opening thereof functions as a display section.

By forming the manipulating section 3M with thermoplastic elastomer, it is possible to fusion-bond the manipulating section 3M to the supporting member 3 or mold the both as an integral piece. In this regard, the thermoplastic elastomer is transparent, it may be colored for the purpose of reducing the light emission from the peripheral region to stabilize the light receiving operation in the light receiver section 210 and improve the user's visibility. Or, material other than the elastomer may be used. If the manipulating section 3M is formed of transparent material together with the supporting member 3 to be integral with the light guiding section 580, at least one of front and rear surfaces of the manipulating section 3M forming the light emission limiting member may be roughened or subjected to a blast treatment or coated with paint so that the light emission is restricted.

Also in this embodiment, it is possible to have a so-called picture frame-like contrast on the periphery of the display section by properly limiting the light emission from the display section, whereby favorable light volume is obtainable for improving the user's visibility and stabilizing the operation of the light receiver section.

Also in this embodiment, if at least part of the light guiding section 580 from which the light is emitted has the same shape as in the first embodiment, it is possible to compensate for the deviation of the light receiving section 210 in the x, y and z directions due to the mounting tolerance thereof and stabilize the light volume received by the light receiver section. Accompanied therewith, it is possible to widen an area visible by the user to ensure the favorable visibility.

4. Others

The present invention should not be limited to the above-mentioned embodiments but includes various modifications without departing from the spirit of the present invention.

Figure 15:
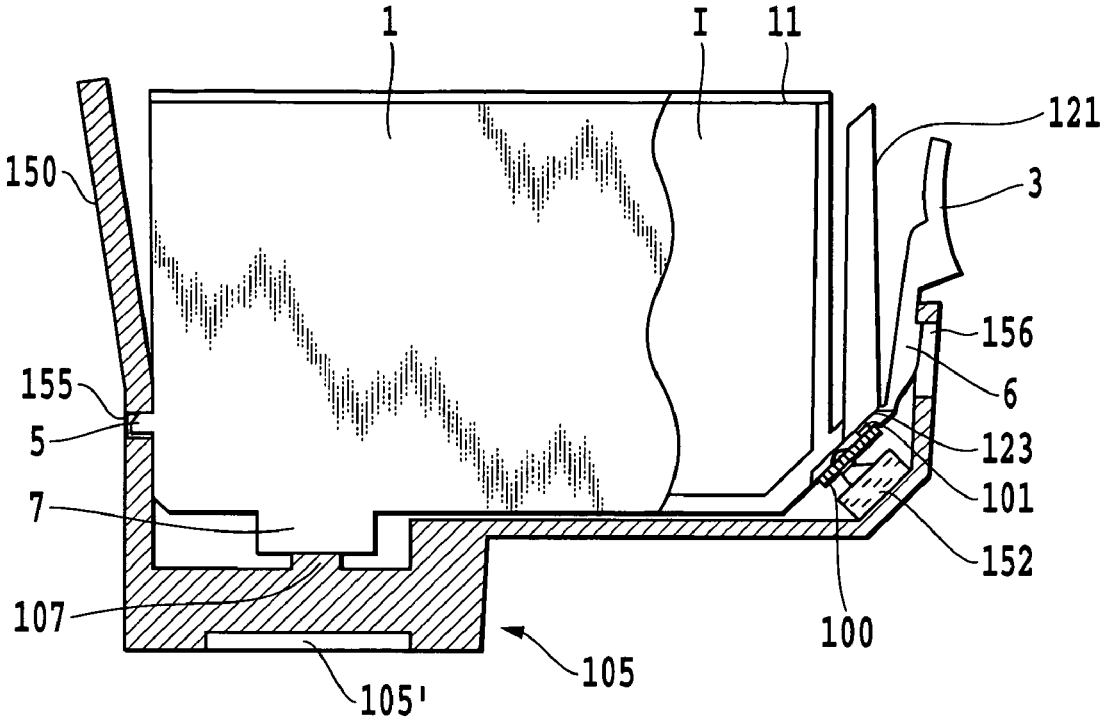
FIG. 15 is a schematic side view illustrating an ink tank according to a further embodiment of the present invention.

First, the structure and shape of the light guiding section are not limited to the above-mentioned ones but includes many other ones. For example, the light guiding section is not necessarily integral with the outer casing or the supporting section of the ink tank, but as shown in FIG. 15, the light guiding section 121 may be formed separately from the outer casing of the ink tank 1, after which the both are assembled together. In this structure, the respective member can be made of material more suitable for its function. For example, as material for the light guiding section 121, one having a high refractive index capable of well guiding the light beams emitted from the light emitting section, such as polycarbonate or polyacrylate having a large difference in refractive index from air may be selected. On the other hand, as material for the outer casing of the ink tank 1, polypropylene may be selected, having a high effect for restricting the evaporation of the ink I stored in the tank. Since the respective member may be formed of different material, the material for a component part of the ink tank 1 or the supporting member 3 in which the light emission limiting member is not limited to be transparent and can be suitably selected. That is, it is possible to form a part functioning as the light emission limiting member without subjecting the same to a special treatment. The light guiding section is not indispensable in the present invention. For example, it is possible to form a structure in which light emitted from the light emitting section 101 is directly limited by the light emission limiting member by providing the light emitting section 101 in a position adjacent to the opening 21A or the manipulating section 3A.

An air layer may be eliminated between the ink storage chamber 11 and the light guiding section but, instead, a member having a lower refractive index than the light guiding section or a metallic reflective member may be disposed between the ink storage chamber 11 and the light guiding section 121. Alternatively, instead of guiding the light by using the difference in refractive index between the light guiding section and air or different kind of material in contact therewith, an optical fiber consisting of a core and a clad may be applied. Also, a solid light guiding section is not used but a hollow member having a reflective inner surface (such as a stainless steel pipe) may be employed.

Further, the inclined surface provided in the light guiding section performs a function for favorably bending the optical axis toward the display section. Accordingly, the inclined surface is designed so that an angle between the inclined surface and the optical axis of the light beam guided by the light guiding section 450 (or an incident angle) coincides with an angle of the optical axis reflected toward the display section (or a reflective angle). Such a design may be properly done within a range satisfying the condition of total reflection in accordance with materials use and/or the bending angle. To effectively reflect the light, the inclined surface may be formed of highly refractive or highly reflective material or adhered with a metallic foil. Instead of providing such an inclined surface, the light guiding section may be of a bending shape. Or, if the bending of the optical axis is unnecessary provided a position of the display section allows, the inclined surface or the bending portion is useless, and the display section may be vertical to the major axis of the light guiding section.

In either cases, basically, the light emitting section is separated from the display section and the light guiding section is provided in the ink tank for optically connecting the both with each other. Thereby, it is possible to obtain a structure in which the light emitting section and the display section are individually disposed at the best positions, respectively, at a low cost, without needing the wiring for the power supply or the signal transmission disturbing the user's visibility and manipulation. Thus, it is possible to make sure of the degree of freedom for disposing the display section at a position at which the user's visibility is best, whereby the user easily can see a state of the light emission and know the predetermined information regarding the ink tank.

By suitably limiting the light emission from the display section, it is possible to provide a so-called picture frame-like contrast on the periphery of the display section to obtain a favorable light volume both for the improvement in user's visibility and the operational stability of the light receiver section.

The present invention is also applicable to an ink tank having no light emitting section in the above-mentioned embodiments. For example, as a light emitting section, a light source may be provided on the printer side. In such a structure, when ink has been exhausted in a certain ink tank, the light source is switched on at an instant when the light incident surface of the light guiding section in this ink tank is opposed to the light source. Thus, the information is transmitted via the display section.

In the above description, the present invention is applied to a printer having an ink supply system in which an amount of ink corresponding to that of the ejected ink is always continuously supplied to the printing head (a continuous ink supply system). Especially, described is a structure using ink tanks detachably attached to the printing head subjected to the reciprocation (a main scan) while being mounted to the carriage or the like. The present invention, however, is also applicable to a structure in which the ink tanks are indivisibly attached to the printing head. Even in such a structure, if the mounting position is erroneous, a desired quality level of the resultant print is not obtainable because improper color data is received or the sequence of color overlapping becomes different from the designed one.

The present invention is also applicable to another continuous ink supply system in which ink tanks are attached to fixed positions in the printing apparatus separately from the printing head mounted to the carriage and ink is fed through a flexible tube connecting the fixed ink tank to the printing head. That is, regarding the fixed ink tank, either one of the above-mentioned light guiding sections is applicable. In this case, the fixed ink tank is disposed within a scanning range of the carriage, and the light receiver section for the detection or control on the printer side is provided on the carriage.

Further, such a structure is applicable not only to the continuous ink supply system using the tube but also to an intermittent ink supply system. The latter system is a system in which an ink storage section for storing a small amount of ink (an intermediate tank) is provided in the printing head and is properly and intermittently supplied with ink from an ink supply source for storing a large amount of ink (a fixed ink tank). In this system, the fixed ink tank may be spatially connected to the ink supply system only when ink is filled in the intermediate tank. Alternatively, the tube communication structure may be employed and properly opened or closed by a valve or others to shut or connect the fluid communication between both the tanks.

In addition, while ink tanks of yellow, magenta, cyan and black inks are used in the above-mentioned embodiments, the color tone of used ink (color and concentration) or the number of ink tanks are, of course, not limited thereto. In addition to these inks, light color inks and particular color inks including red, green, blue inks or others may be used. Particularly, as the number of ink tanks increases, the erroneous attachment thereof is liable to occur, the visibility or the manipulation of the attachment/detachment is largely disturbed, or the mis-identification of the display state in the ink tank may generate. Accordingly, the present invention is effective for preventing such troubles.

The present invention has been described in detail with respect to preferred embodiments, and it will now be apparent from the foregoing to those skilled in the art that changes and modifications may be made without departing from the invention in its broader aspect, and it is the intention, therefore, in the apparent claims to cover all such changes and modifications as fall within the true spirit of the invention.

This application claims priority from Japanese Patent Application No. 2004-306130 filed Oct. 20, 2004, which is hereby incorporated by reference herein.

What is claimed is:

1. A liquid container for storing liquid used in an ink jet printing apparatus, comprising:

a display section for displaying information by emitting light, and a light emission limiting member disposed on the periphery of said display section;

wherein said light emission limiting member is formed of thermoplastic elastomer fusion-bondable to a member forming said liquid container.

2. A liquid container as defined by claim 1, wherein said light emission limiting member is disposed to enclose the said display section in a picture frame manner.

3. A liquid container as defined by claim 1, wherein said light emission limiting member is made of the same material as said liquid container.

4. A liquid container as defined by claim 3, wherein said light emission limiting member is colored by adding color pigment thereto.

5. A liquid container as defined by claim 1, wherein a light guiding section is provided for guiding light from a light emission source to said display section.

6. A liquid container as defined by claim 5, wherein said light guiding section has a portion emitting light as said display section.

7. A liquid container as defined by claim 5, wherein said light guiding section has a portion for emitting light to a manipulating section for carrying out the attachment of said liquid container to said ink jet printing apparatus or a member mounted thereto; said display section and said light emission limiting member are provided in said manipulating section as an opening for emitting light therethrough and a portion forming the opening, respectively.

8. A liquid container as defined by claim 7, further comprising a light emitting section as said light emission source and a contact for receiving a signal for driving said light emitting section when mounted.

9. A liquid container as defined by claim 1, capable of being detachably mounted to said ink jet printing apparatus or a member attached thereto.

10. A liquid container as defined by claim 1, wherein ink is stored as said liquid.

11. An ink jet printing apparatus having a light receiver section capable of being opposed to said display section, for carrying out the printing operation by using said liquid container defined by claim 10.

* * * * *